US005957067A

United States Patent [19]

Döbbeling et al.

[11] Patent Number: 5,957,067

[45] Date of Patent: Sep. 28, 1999

[54] CERAMIC LINER

[75] Inventors: Klaus Döbbeling, Windisch; Armin Heger, Nussbaumen, both of Switzerland; Andreas Pfeiffer, Lauchringen, Germany

[73] Assignee: ABB Research Ltd., Zurich, Switzerland

[21] Appl. No.: 09/119,585

[22] Filed: Jul. 21, 1998

[30] Foreign Application Priority Data

Jul. 28, 1997 [CH] Switzerland ..... 97810539

[51] Int. Cl.[6] ..... F23M 5/00; F23M 5/02; E04B 2/00; F27D 1/14

[52] U.S. Cl. ..... 110/336; 110/338; 52/506.01; 52/506.03; 432/252

[58] Field of Search ..... 110/336, 338; 432/252; 202/267.1; 52/506.01, 506.02, 506.03, 506.04, 506.05, 784.11, 784.15, 794.1, 513; 126/147, 150, 151

[56] References Cited

U.S. PATENT DOCUMENTS 463,308 11/1891 Morrin ..... 110/336
5,624,256 4/1997 Pfeiffer et al. ..... 110/336

FOREIGN PATENT DOCUMENTS

0224817A1 6/1987 European Pat. Off. .
0724116A2 7/1996 European Pat. Off. .
0741268A1 11/1996 European Pat. Off. .
19502730A1 8/1996 Germany .
790292 2/1958 United Kingdom .

*Primary Examiner*—Ira S. Lazarus
*Assistant Examiner*—David Lee
*Attorney, Agent, or Firm*—Burns, Doane, Swecker & Mathis, L.L.P.

[57] ABSTRACT

In the case of a ceramic liner for combustion spaces, comprising at least one wall element (3), made of refractory structural ceramic and having at least one through-opening (6), and a fastening element (4), consisting of refractory structural ceramic, per opening (6), the fastening element (4) is resiliently fastened by its foot in a metallic holding device (5) fastened on the metallic supporting wall (1). The head (20) of the fastening element (4) rests in the opening (6) in the wall element (3).

The wall element (3) is designed in the form of a box, having a base (25) which runs parallel to the metallic wall (1), having an inside wall (23) which surrounds the opening (6) in an annular manner and is supported directly or indirectly on the metallic supporting wall (1), and having outside walls (24) which extend up to the metallic supporting wall (1) without touching the latter.

5 Claims, 2 Drawing Sheets

CERAMIC LINER

BACKGROUND OF THE INVENTION

1. Field of the Invention

The invention relates to a ceramic liner according to the preamble of patent claim 1. Such liners are used in particular as an inner wall insulation of metallic combustion chambers.

2. Discussion of Background

A ceramic liner of the type mentioned at the beginning is known from DE 195 02 730 A1. The liner there has the purpose of an uncooled detachable liner of a combustion space with ceramic elements which withstand the high mechanical and thermal stresses in a commercial heavy-duty combustion chamber.

For this purpose, the liner comprises at least one wall panel, made of refractory structural ceramic and having at least one through-opening, and a fastening element per opening. The fastening element is fastened by its foot in a metallic holding device fastened on the metallic supporting wall. The head of the fastening element rests in the opening in the wall panel. The fastening element consists of refractory structural ceramic and is resiliently coupled to the holding device. Arranged between the metallic wall and the ceramic wall panel is an insulating layer. Regarded as the advantages are that the liner can withstand very high mechanical and thermal stresses on account of its homogeneity and the material used and that the liner can be disassembled without being destroyed and can therefore be used repeatedly. Furthermore, the resilient coupling of the ceramic structure to the metallic holding construction allows the thermal expansions between metallic and ceramic components or deformations of the insulating layer due to mechanical stresses to be absorbed.

In the case of this known liner, the thickness of this insulating layer is chosen according to the thermal loading of the overall liner assembly. It must be set at such a thickness that the maximum permissible temperatures of the metallic supporting wall are not exceeded. The insulating material can be applied, for example, in the form of prefabricated blocks, an appropriate bore for the mounting of the liner having to be provided in the region of the fastening bolt. Since the mounting distance between two wall panels is determined by the thermal expansions of the wall panels, the insulating material is strengthened in a suitable way on its surface, or otherwise protected, at least in the region beneath the joints of two neighboring panel elements, so that a flushing out of the insulating layer is avoided if there are parasitic hot air flows in the gap. Owing to virtually unavoidable vibrations of the combustion chamber or due to thermal influences, the insulating layer may, however, change its shape. This can lead to a loosening of the fastening, which after some time may result in loss of the insulating layer.

SUMMARY OF THE INVENTION

Accordingly, one object of the invention is to provide a novel ceramic liner of the type mentioned at the beginning which manages without the previous insulating layer between the metal wall and the ceramic wall element.

This is achieved according to the invention by the defining features of patent claim 1.

To be regarded in particular as the advantage of the invention is that, in addition to the function as a heat shield, with the novel convection-free liner the temperature gradient is set purely by heat radiation. Dispensing with unstable insulating materials leads to an operationally more reliable liner, which also manages with a smaller number of individual parts.

It is expedient if the wall element comprises a plurality of boxes inserted one inside the other or slipped one over the other. In this case, the inside wall of the outer box can be supported on the inside wall of the box near the wall.

It is particularly favorable if the head of the fastening element resting in the opening in the wall element is stepped and has at least two bearing surfaces arranged between the base and the metallic wall, one of these bearing surfaces in each case cooperating with the bearing surface of one of the boxes inserted one inside the other. By this measure, in the possible event of rupture of the outer ceramic part, facing the hot gas flow, the metallic wall continues to be protected by the inner ceramic part, as a result of which emergency operation is possible.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein several exemplary embodiments of the invention are represented

DESCRIPTION OF THE PREFERRED EMBODIMENTS

Figure 1:
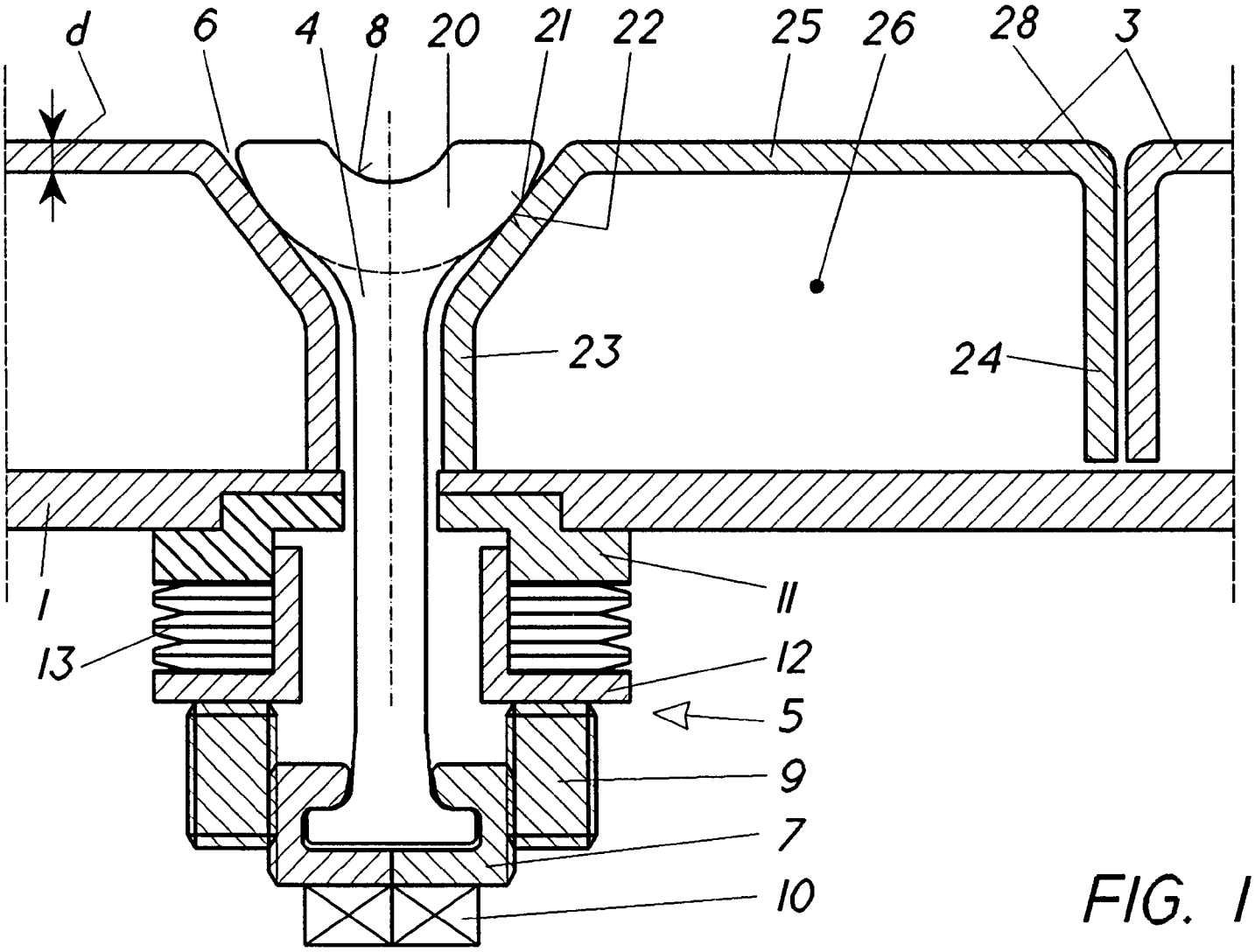
FIG. 1 shows a partial longitudinal section of the liner for a gas-turbine combustion chamber.

Referring now to the drawings, wherein like reference numerals designate identical or corresponding parts throughout the several views and only the elements essential for understanding the invention are shown, in FIG. 1 there is a partial longitudinal section of the liner according to the invention for a gas-turbine combustion chamber. Arranged next to one another on the metallic supporting wall 1 of the combustion chamber are ceramic wall elements 3. They consist of refractory structural ceramic, for example SiC or Si3N4. These wall elements 3 are fastened on the metallic supporting wall 1 with the aid of fastening elements 4, which are in each case arranged in a metallic holding device 5, which is described in detail later. Like the wall elements 3, these fastening elements 4 likewise consist of refractory structural ceramic.

Figure 2:
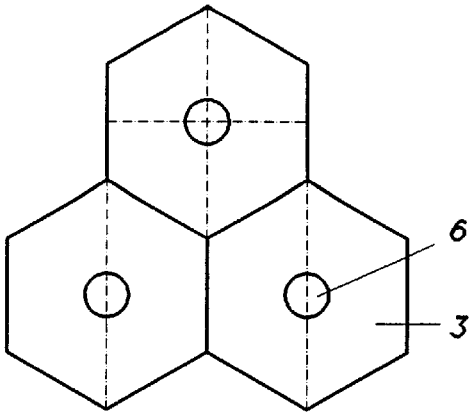
FIG. 2 shows a plan view of the liner, using hexagonal ceramic wall elements.

The outer form and dimensions of the wall elements 3 can be adapted unproblematically to the geometry of the space to be lined and are not predetermined in any way. FIG. 2 shows in plan view a possible form of the wall elements 3. In this design variant, they have a hexagonal outer contour. For reasons of simple manufacture and uniform stress distribution under thermal and mechanical stress, symmetrical forms are to be preferred. The thickness d of the wall elements 3 is governed on the one hand by the required mechanical stability and on the other hand by a minimization of the thermal stresses on account of temperature gradients in the component. In the simplest case, a square contour may also be used, in order to line planar or only slightly curved combustion spaces. Similarly, wall elements 3 with a rectangular, triangular or any polygonal outer contour can also be used. One of the determining factors is that the elements—whether individually or in an assembly—are arranged securely against twisting.

According to the invention, a wall element 3 is designed in the form of a box. As shown in FIG. 1, it substantially comprises a base 25 which runs parallel to the metallic wall 1 and the outside of which is directed toward the hot combustion space. In the center of the base 25 there is arranged a through-opening 6 for receiving a fastening element 4, which in this case is a bolt which comprises a head, shank and foot. It goes without saying that, in other exemplary embodiments not shown here, there may also be a plurality of openings 6 in each wall element 3. The inside wall 23 of the box, running perpendicularly with respect to the metallic wall and surrounding the opening 6 in an annular manner, is supported on the metallic supporting wall. The outside walls 24, likewise running perpendicularly with respect to the metallic wall, extend from the base of the box up to the metallic supporting wall 1, but without touching the latter. The novel form of the wall element 3 creates a convection-free chamber, in which the heat exchange substantially takes place by radiation. Neighboring chambers are mounted with a small gap 28 between their outside walls 24. This gap compensates for production and mounting inaccuracies and for operationally caused thermal expansions. Moreover, it serves as a restrictor for gas flows.

The contact surface between the head 20 of the fastening element 4, arranged in the opening 6, and the wall element 3 is configured in an optimum way, in order to ensure definite contact even in the case of slight angular positions of the bolt. For this purpose, the head 20 is provided with a spherical bearing surface, which bears with its rounded portion 21 on a cross-sectionally straight bearing surface 22. This straight portion is the connection, tapered in the region of the opening 6, between the base 25 and the inside wall 23 of the wall element. As a result, on the one hand the contact surface between the fastening element 4 and the wall element 3 is enlarged, on the other hand the heat flows in cases of stress gradients of a steady state and non-steady state are influenced in such a way that only minimal thermal stresses occur. The geometrical shaping of this zone results from a trade-off between the heat-accumulating and heat-conducting properties of the materials used. With this measure, even the region in which linear contact occurs can be easily determined, since the tolerances to be expected are generally known. The Hertzian stress occurring in the case of the surfaces pressed against one another—here convex surface against planar surface—is much less than in the case of the known ball/ball seats and can easily be determined analytically. Nevertheless, a good sealing effect is also achieved here, if desired in the first place. This sealing against the cooling air is provided on the one hand by the described seating between the bolt and the inner ceramic body of the wall element, on the other hand by the bearing surface of the inside wall 23 of the box on the metallic supporting wall and the arrangement of the fastening element on the metal wall on the cooling air side.

For this ceramic fastening element 4 there is provided an expansion-tolerant flexible restraint on the outside of the metallic supporting wall 1. According to FIG. 1, the metallic holding device 5 comprises a longitudinally divided threaded sleeve 7, which encloses the foot of the fastening element. Arranged on the external thread of the threaded sleeve 7 is a threaded nut 9, by means of which the restraining force can be set, as explained further below. At the same time, the nut 9 holds the two halves of the threaded sleeve 7 together. The mutual positioning of the two halves of the threaded sleeve can be secured by additional constructional elements, for example the bolts. A square 10 serves the purpose of holding the divided sleeve during the tightening of the threaded nut 9. Items 7 and 10 are part of the divided sleeve.

Furthermore, the metallic holding device 5 comprises a guide ring 11, which is recessed into the metallic supporting wall 1, a one-part guide sleeve 12 for the fastening element 4, and spring elements 13 arranged between the guide sleeve 12 and the guide ring 11. The spring 13 is, for example, as represented in FIG. 1, a cup spring. The resilient coupling of the ceramic structure to the metallic holding device achieves the effect that relative thermal expansions between the metallic and ceramic components are absorbed, without inadmissibly high stresses in the ceramic component being induced at the contact surfaces. Virtually constant restraining forces are ensured by means of a specific resilient excursion of the restraint (which can be set by means of the threaded nut 9 screwed on to the external thread of the sleeve 7).

Figure 3:
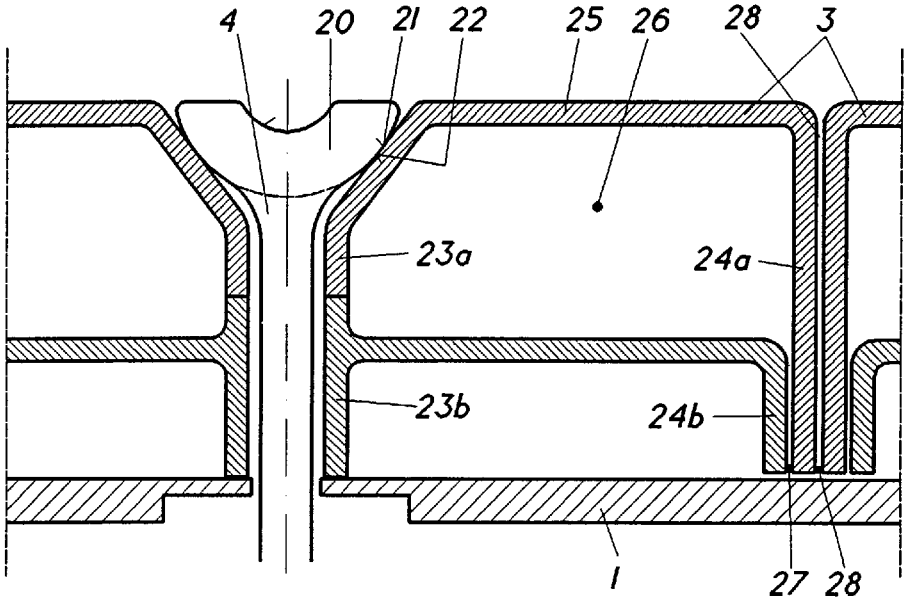
FIG. 3 shows a first design variant of the liner with a plurality of chambers.

In FIG. 3 there is represented a radiation-cooled two-layer combustion chamber liner, in which the wall element (3) comprises two boxes 26*a*, 26*b* slipped one over the other. The inside wall 23*a* of the outer box 26*a* is supported on the inside wall 23*b* of the box 26*b* close to the wall. The outside walls of the two boxes 26*a*, 26*b* run parallel to each other and enclose a sealing gap 27 between them.

In this way, a heat shield toward the inside of the combustion chamber is formed by pure radiation cooling to the outside of the combustion chamber. The boxes form convection-free chambers, in which the heat transfer takes place only by radiation. It is possible to dispense with unstable insulating material and separate cooling air.

Figure 4:
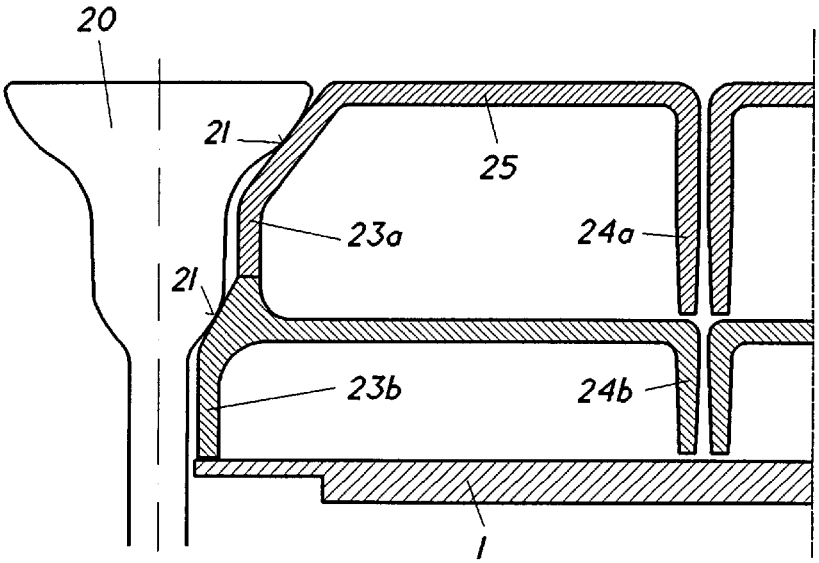
FIG. 4 shows a design variant of the fastening bolt.

In FIG. 4 there is likewise represented a two-layer combustion chamber liner, in which the wall element 3 comprises two boxes 26*a*, 26*b* slipped one over the other and the inside wall 23*a* of the outside box 26*a* is supported on the inside wall 23*b* of the box 26*b* close to the wall. The outside walls 24*a* and 24*b* of the two boxes extend in an identical plane. In the case of this solution, the inside walls run only approximately perpendicularly with respect to the metal wall; they are adapted in their shape to the form of the head 20 of the fastening element. This head has two steps, each step being provided with its own spherical bearing surface 21. Accordingly, the boxes slipped one over the other also each have a straight bearing surface on their inside walls. Such a redundant design is suitable in particular for emergency operation. If, for example, the radially outer step were to fail as a result of damage to the box 26*a*, the inner box can still perform its heat shield function.

The contactless design of the outside walls 24 with respect to the metallic supporting wall 1, the sealing gaps 27 and the small gaps 28 between neighboring chambers are based on the following considerations. The aim is to prevent mutual contact between components and at the same time to form restrictors for possible gas flows. In this respect, the size of the various gaps is governed on the one hand by production tolerances and on the other hand by the thermal expansions occurring during operation. To ensure the restricting effect, the gaps will be made less than 0.5 mm.

It goes without saying that the invention is not restricted to the embodiment shown and described. As a departure from the contactless arrangement of the outside walls 24 of the wall element with respect to the metallic wall to be cooled, a sealing connection could also be considered. This solution with boxes then closed on all sides will be used whenever, for example, the box should be evacuated.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A ceramic liner for combustion spaces, comprising at least one wall element, made of refractory structural ceramic and having at least one through-opening, and a fastening element, consisting of refractory structural ceramic, per opening, the fastening element being resiliently arranged with its foot in a holding device fastened on the metallic supporting wall, and the head (20) of the fastening element resting in an opening in the wall element, wherein the wall element is designed in the form of a box, having a base which runs parallel to the metallic wall and the outside of which is directed toward the combustion space, having an inside wall which runs at least approximately perpendicularly with respect to the metallic wall, surrounds the opening in an annular manner and is supported directly or indirectly on the metallic supporting wall, and having outside walls which run at least approximately perpendicularly with respect to the metallic wall and extend up to the metallic supporting wall without touching the latter.

2. The ceramic liner as claimed in claim 1, wherein the free end faces of the outside walls do not touch the supporting wall and with the latter enclose a gap.

3. The ceramic liner as claimed in claim 1, wherein the wall element comprises a plurality of boxes inserted one inside the other or slipped one over the other, the inside wall of the outer box being supported on the inside wall of the box close to the wall.

4. The ceramic liner as claimed in claim 3, wherein the outside wall of the boxes run parallel to each other and enclose a sealing gap between them.

5. The ceramic liner as claimed in claim 3, wherein the head of the fastening element resting in the opening in the wall element is stepped and has at least two bearing surfaces arranged between the base and the metallic wall, one of these bearing surfaces in each case cooperating with the bearing surface of one of the boxes inserted one inside the other.

* * * * *